US008857663B2

(12) United States Patent
Schölvinck et al.

(10) Patent No.: US 8,857,663 B2
(45) Date of Patent: Oct. 14, 2014

(54) CONTAINER FOR DISPENSING A SUBSTANCE

(75) Inventors: Michiel Olivier Schölvinck, Arnhem (NL); Robert Willemsen, Huizen (NL); Sebastiaan Willem Hekkenberg, Utrecht (NL); Roeland Petrus Maria van Oirschot, Leusden (NL); Edouard Sterngold, Viterbo (IT)

(73) Assignee: MDS Global Holding Ltd., Sliema (MT)

( * ) Notice: Subject to any disclaimer, the term of this patent is extended or adjusted under 35 U.S.C. 154(b) by 55 days.

(21) Appl. No.: 13/505,855

(22) PCT Filed: Nov. 12, 2009

(86) PCT No.: PCT/NL2009/000218

§ 371 (c)(1),
(2), (4) Date: Jun. 11, 2012

(87) PCT Pub. No.: WO2011/059313

PCT Pub. Date: May 19, 2011

(65) Prior Publication Data

US 2012/0241455 A1 Sep. 27, 2012

(51) Int. Cl.

| | |
|---|---|
| ***B65D 35/54*** | (2006.01) |
| ***B65D 83/00*** | (2006.01) |
| ***B65D 77/20*** | (2006.01) |

(52) U.S. Cl.

CPC ..... *B65D 77/2036* (2013.01); *B65D 83/0094* (2013.01); *B65D 2577/2066* (2013.01)

USPC ..... 222/96; 222/107; 222/325; 222/541.4; 215/16; 215/250; 99/295; 99/323.3; 206/469; 206/484; 220/268

(58) Field of Classification Search

USPC ..... 222/92–107, 325, 541.1–541.9, 129.1, 222/153.05–153.06; 426/395–396, 426/413–414; 264/466; 53/136.3, 284.2, 53/410, 416, 420, 467, 559, 561, 574; 383/36, 200–209, 906; 215/45, 16, 215/250, 326–327; 99/295, 297, 289 R, 99/302 R, 323.3; 206/469, 484, 820, 824; 220/268, 281, 284; 7/151

See application file for complete search history.

(56) References Cited

U.S. PATENT DOCUMENTS 3,575,325 A * 4/1971 Leeds et al. ..... 222/541.6
4,301,923 A * 11/1981 Vuorento ..... 206/484

(Continued)

FOREIGN PATENT DOCUMENTS

EP 0299571 A1 1/1989
FR 1210375 A 3/1960

(Continued)

OTHER PUBLICATIONS

English Machine Translation of FR1210375.

*Primary Examiner* — Paul R Durand
*Assistant Examiner* — Andrew P Bainbridge
(74) *Attorney, Agent, or Firm* — John S. Sopko; Hoffmann & Baron, LLP

(57) ABSTRACT

A container containing a substance includes a preformed deformable body defining a filling cavity. The container body has an opening and an integral planar circumferential rim surrounding the opening, which opening is closed by a cover sheet which is sealed to the circumferential rim by means of a circumferential sealing seam. The circumferential rim has a dispensing part which is covered by the cover sheet. The cover sheet is sealed to an upper surface of the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part.

16 Claims, 3 Drawing Sheets

(56) References Cited

U.S. PATENT DOCUMENTS

| | | | | |
|---|---|---|---|---|
| 4,717,046 | A * | 1/1988 | Brogli | 222/107 |
| 5,348,191 | A * | 9/1994 | Dekeyser | 222/107 |
| 5,529,224 | A * | 6/1996 | Chan et al. | 222/212 |
| 6,085,942 | A * | 7/2000 | Redmond | 222/107 |
| 6,845,597 | B2 * | 1/2005 | Redmond | 53/260 |
| 2008/0148948 | A1 * | 6/2008 | Evers et al. | 99/275 |
| 2008/0230571 | A1 * | 9/2008 | Sterngold et al. | 222/541.4 |

FOREIGN PATENT DOCUMENTS

| | | |
|---|---|---|
| WO | 2005/077811 A2 | 8/2005 |
| WO | 2007/025773 A2 | 3/2007 |

* cited by examiner

CONTAINER FOR DISPENSING A SUBSTANCE

CROSS-REFERENCE TO RELATED APPLICATIONS

This application is the National Stage of International Application No. PCT/NL2009/000218, filed Nov. 12, 2009, the contents of which is incorporated by reference herein.

FIELD OF THE INVENTION

The present invention relates to dispensing a substance from a container by means of a dispensing apparatus.

BACKGROUND OF THE INVENTION

The present invention proposes to dispense a substance from a container filled with a single portion of substance. In particular the substance may be a concentrate, like e.g. a syrup for preparation of a beverage. The container comprises a preformed deformable body, preferably made of sheet material, defining a filling cavity, which body has an opening and an integral planar circumferential rim at least partly surrounding said opening. The opening is closed by a cover sheet which is sealed to the planar circumferential rim by means of a sealing seam.

According to the invention the substance, e.g. syrup for a soft drink or a concentrate for coffee or other beverages may be dispensed by the dispensing apparatus directly from the container into a serving container, e.g. a glass, a cup, or a bottle. Also water is dispensed by the dispensing apparatus into the serving container such that mixing of the substance and the water takes place in the serving container thereby preventing the contamination of the dispensing apparatus with the substance, which is advantageous in view of cleaning and maintenance of the apparatus. Furthermore it warrants that concentrates for different beverages are not contaminating each other when subsequently different beverages are prepared by the apparatus.

From WO 2005/077811 and WO 2007/025773 such a dispensing system is known.

The known dispensing system makes use of the deformability of the cover sheet for opening the container. The container body is retained and compressed by compressing means in the dispensing apparatus. The sealing seam comprises a predetermined rupturing zone. When the container body is compressed, a part of the covering sheet located near the rupturing zone of the sealing seam bulges out due to the internal pressure in the container. Thereby the sealing seam is ruptured at the predetermined rupturing zone and substance is expelled out of the created passage due to the internal pressure.

Advantageously the containers of the type according to the invention may be formed and filled by a so called Form, Fill and Seal process (FFS), in which a plurality of cup-like container bodies are formed from a flat sheet of plastic or other suitable material by a vacuum or thermo forming process. Next, the container bodies are filled with substance. After the container bodies of the sheet have been filled, a cover sheet, e.g. an aluminium foil is sealed over the container bodies. Finally, the circumferential rims of the containers are formed by cutting waste material away from the sheet between the container bodies. The containers resulting from one sheet may be separated from each other by the cutting operation.

It is an object of the present invention to provide improved containers for such a dispensing system.

SUMMARY OF THE INVENTION

According to a first aspect of the invention this object is achieved by a container containing a substance, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to an upper surface of the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part—in a region delimited by the rupturable sealing seam, the outlet seams and the edge of the dispensing part—has an indented surface, which indented surface is spaced apart from the rupturable sealing seam and the outlet seams and extends over a distance from said edge of the dispensing part towards the rupturable sealing seam.

According to a second aspect of the invention a container containing a substance is provided, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part—in a region delimited by the rupturable sealing seam, the outlet seams and the edge of the dispensing part—has an indented surface, which indented surface is spaced apart from the rupturable sealing seam, the outlet seams and said edge of the dispensing part.

The second aspect of the invention proposes to provide an indent in the dispensing passage in the upper surface of the dispensing part, but at a distance from the dispensing edge of the dispensing part. This indent provides the possibility to press on the covering foil at the location of the indent whereby the foil is pressed into the indent. This will stress the foil and will rupture any inadvertent seal formed between the dispensing edge of the dispensing part and the foil caused by the cutting tool. This pressing of the covering foil can be done during production, but it is also possible to provide the dispensing apparatus with a member, which will press the foil automatically when the container is placed in the dispensing apparatus.

According to a third aspect of the invention is proposed a container containing a substance, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part has a substantially flat upper surface and wherein the outlet seams at least at a portion near the edge converge towards each other.

The outlet seams that according to this third aspect converge force the substance to flow through a smaller opening at the dispensing edge. This prevents that a shower of different flows or jets is exiting from the dispensing edge. Thereby spoiling of the dispensing apparatus is prevented.

According to a fourth aspect of the invention is provided a container containing a substance, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part has a substantially flat upper surface and wherein a rupturable tail end seal is provided which extends from the rupturable sealing seam to the edge between the filling cavity and the flat dispensing part.

The rupturable tail end seal extends on the flat upper surface of the dispensing part up to the edge between the filling cavity and the upper surface of the dispensing part. Since the tail end seal is preferably only a line shaped sealing seam, considerably more cover foil material is "free" to bulge out around it, whereby at the tail end seal the rupturing is easiest and will be initiated after which the rupturing will progress towards and into the rupturable sealing seam. Preferably the tail end seal is positioned in the centre of the outlet passage, such that the rupturing of the rupturable sealing seam starts in the middle.

According to a fifth aspect of the invention there is provided a container containing a substance, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part has a substantially flat upper surface and wherein the filling cavity has a bottom and a circumferential side wall, wherein at least on the side where the dispensing part is located the side wall has a flat wall portion.

According to the fifth aspect, a flat wall portion is provided in the filling cavity on the side where the dispensing part is provided. This results in a straight edge between the filling cavity and the dispensing part. With fixed outer dimensions of the circumferential rim including the dispensing part (due to the existing dispensing apparatus having a certain dimension for receiving the circumferential rim), said straight edge provides a longer dispensing part. This allows the passage to be longer and thus the rupturable sealing seam, which is mostly in a V-shape, to be more elongate in shape. Thereby, more cover sheet material is "free" to bulge out around it, and the rupturing will initiate more easily in the point of the V-shape. Furthermore a rupturable seal extending over a longer length portion of the outlet passage provides an easier, more gradual opening of the weak seal, with the substance under less pressure, whereby splashing of the substance upon opening the container is mitigated.

A sixth aspect of the invention relates to a container containing a substance, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by a portion of the circumferential sealing seam that comprises strong seal portions and at least one rupturable sealing seam that interconnects the strong seal portions, such that, when the rupturable sealing seam is broken, the substance is allowed to flow through an outlet passage between the surface of the dispensing part and the cover sheet towards a dispensing edge of the dispensing part, wherein said strong seal portions and said rupturable sealing seam together substantially have the shape of a "W", wherein the outer legs of the "W" are constituted by the strong seals and the inner legs of the "W" are constituted by the rupturable sealing seam which inner legs are converging towards the filling cavity, and wherein the outer legs are diverging.

The sixth aspect of the invention provides a sealing seam sealing the covering sheet to the dispensing part, which sealing seam has a general W-shape. The central portion of the "W" is constituted by the rupturable sealing seam, which has the shape of an inverted "V". The advantage of this sealing seam configuration is that there is overall a greater distance between the rupturable sealing seam and the strong sealing seams on the dispensing part, whereby a greater portion of the covering sheet is allowed to bulge out. Thereby the rupturable seal will open under a lower internal pressure in the container and a more gradual opening results. A more gradual rupturing under a lower pressure of the rupturable sealing seam results in a reduction elimination of the splashing of the outgoing flow of substance.

According to a seventh aspect of the invention a container containing a substance is provided, comprising a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which is covered by the cover sheet, which cover sheet is sealed to the dispensing part by at least one rupturable sealing seam and outlet seams defining an outlet passage from the rupturable sealing seam towards the edge of the dispensing part of the circumferential rim, such that, when the rupturable sealing seam is broken, the substance is allowed to flow through the outlet passage between the surface of the dispensing part and the cover sheet towards the edge of the dispensing part, wherein the dispensing part at its dispensing edge is recessed with respect of the edge portion of the cover sheet.

Alternatively, according to the seventh aspect of the invention, the cover sheet may be recessed relative to the dispensing edge of the dispensing part.

The seventh aspect of the invention provides the feature that at the dispensing edge the layers of material are not overlying, whereby it is prevented that during cutting of the circumferential rims during production, the covering foil is pressed by the cutting tool in the top surface of the dispensing part to such an extent that an inadvertent sealing takes place at the dispensing edge.

In the above mentioned different aspects of the invention the rupturable sealing seam preferably is a weakened sealing seam, which is for example thinner than the other sealing seams attaching the covering sheet to the circumferential rim of the container.

However it is not in all cases necessary to have a weakened sealing seam. In some applications all sealing seams attaching the cover sheet to the circumferential rim may be of the same strength and it is sufficient that the rupturable sealing seam is surrounded by a sufficient area of cover sheet material, preferably cover foil, that is allowed to bulge out. In other words, in some occasions it is sufficient that the point where the rupturing should initiate is spaced sufficiently from the other sealing seams. The specific geometry of the sealing seams in this case provides for the effect that the sealing seams upon pressurizing the content of the container will brake at the rupturable sealing seam.

Yet another aspect of the invention relates to a method for manufacturing containers as described in the above, wherein a flat sheet is placed in a vacuum or thermo forming apparatus with a forming die, and multiple container bodies are formed simultaneously in the sheet by vacuum forming the filling cavities into the die, the sheet with the filling cavity is placed in a filling machine and filled with substance, a covering sheet is sealed over the sheet with the container bodies, the sheet with the closed containers is placed in a punch machine, where the perimeter of the circumferential rim of the body is formed by punching out waste material between the containers.

A further aspect of the invention relates to a method for opening a container containing a substance as described in the above, the method comprising the steps of:

holding the container, engaging the cover sheet with a support surface provided with a recess and adapted to support the cover sheet except at the position of the recess, wherein the recess is positioned at least over a part of the circumferential sealing seam, compressing the container body whereby the substance is pressurized and the cover sheet bulges out into the recess such that the rupturable sealing seam is broken at the location where the bulge is formed resulting in the container being open.

Another aspect of the invention relates to a method for preparation of a drink, wherein containers are manufactured by means of the method mentioned above, one of the containers is placed in a drink dispensing apparatus comprising receiving means for receiving and holding the container, the cover sheet is engaged with a support surface provided with a recess and adapted to support the cover sheet except at the position of the recess, wherein the recess is positioned at least over a part of the circumferential sealing seam, a serving container is placed in the drink dispensing apparatus the container body is compressed by the dispensing apparatus whereby the substance is pressurized and the cover sheet bulges out into the recess such that the sealing seam is broken at the location where the bulge is formed resulting in the container being open, the substance is dispensed out of the container directly into the serving container, mixing fluid, in particular water, is dispensed by the drink dispensing apparatus into the serving container and mixed with the substance resulting in a servable drink, the container is removed from the dispensing apparatus.

In said method for preparation of a drink the container is possibly identified by the dispensing apparatus such that the apparatus knows which substance is contained in the container.

The invention will be described in more detail with reference to the drawings.

DETAILED DESCRIPTION OF THE INVENTION

In the following containers according to several aspects of the invention are shown. Each of these containers have in common that they contain a substance, e.g. syrup for a soft drink or a concentrate for coffee or other beverages. The substance is dispensed by a dispensing apparatus directly from the container into a serving container, e.g. a glass, a cup, or a bottle. Also water is dispensed by the dispensing apparatus into the serving container such that mixing of the substance and the water takes place in the serving container. The containers with substance are adapted to be placed dispensing apparatus, which comprises compressing means for compressing the container bodies so as to expel the substance from the container.

Figure 1A:
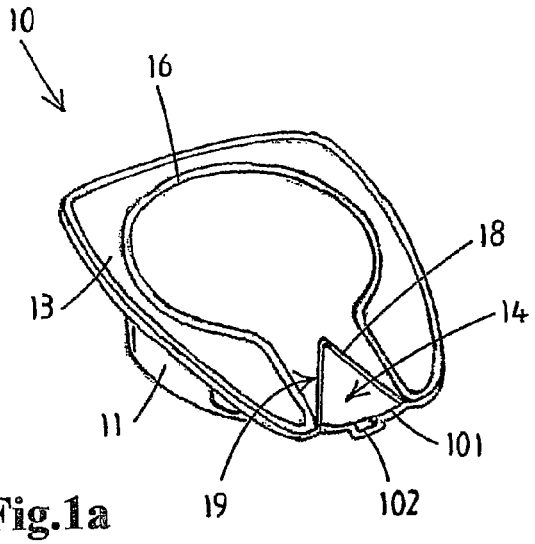
FIG. 1*a* and FIG. 1*b* show in a view in perspective from above and from below respectively, a container according to a first aspect of the invention.
Figure 1B:
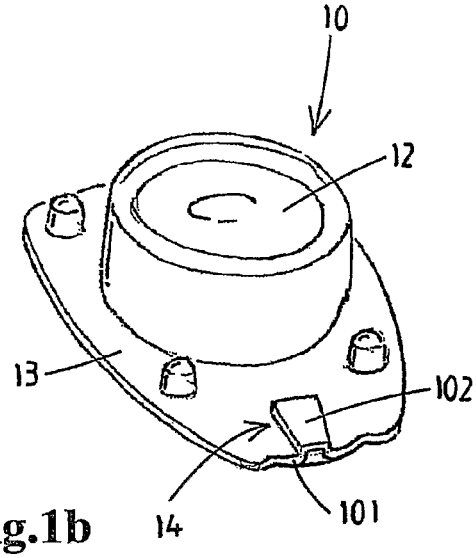

In FIG. 1*a* and FIG. 1*b* a container 10 containing a substance is shown. The container 10 has a generally cup shaped container body 11, preferably made of plastic sheet material or another suitable material. The cup shaped body 11 defines at its inner side a filling cavity in which a substance, e.g. a syrup or another concentrate for preparation of a beverage is contained. The body preferably contains one portion of the concentrate for the preparation of a beverage.

The container body has a bottom portion 12 on one end and on the opposite end the body is open. The open end is surrounded by a circumferential rim 13, sometimes referred to in the art as "flange". The circumferential rim 13 is substantially flat and extends radially outward from the container body 10. The circumferential rim 13 comprises a dispensing part 14, where in use the substance flows along from the filling cavity towards a dispensing edge 101 of the dispensing part 14 as will be described below. The dispensing edge 101 has a convexly curved shape.

The open end of the container body 11 is closed off by a covering sheet 15, preferably a covering foil, e.g. an aluminium foil, which is sealed to an upper surface of the circumferential rim 13 by means of a circumferential sealing seam 16. The circumferential sealing seam 16 seals the foil to the rim over most of the angular range of the circumferential rim 13. At the location of the dispensing part 14, the circumferential sealing seam 16 at each end merges in an outlet seam 17. Each of the outlet seams 17 extends towards the dispensing edge 101 of the dispensing part 14, thereby forming between them a dispensing passage 19 between the foil and the upper surface of the dispensing part 14. In the embodiment shown in FIG. 1 the outlet seams 17 are substantially straight and extend substantially parallel to each other. The passage between the outlet seams 17 is bridged by a rupturable sealing seam 18 sealing off the passage such that the content of the container 10 is closed off from the outside of the container 10.

The rupturable sealing seam 18 as is shown in the Figure has a V-shape with the point of the V directed towards the filling cavity. The legs of the V diverge towards the dispensing edge 101 of the dispensing part 14. It is however conceivable to have another shape of the rupturable sealing seam. As is shown in the Figure, the rupturable sealing seam may preferably be thinner than the other sealing seams of the container 10. Thus a weakened sealing seam is created which ensures that the rupturing starts in the rupturable sealing seam. Alternatively, although more complex, also in other ways a weakened sealing seam may be created, e.g. by different adherence characteristics between the cover foil and the dispensing part at the location of the weakened sealing seam.

A relatively shallow indented surface region 102 is provided in the upper surface of the dispensing part 14 of the circumferential rim. The indent 102 extends from the dispensing edge 101 in the direction of the filling cavity, thus towards the rupturable sealing seam 18. The indent 102 is spaced apart from, hence does not cross, the sealing seam.

The container 10 is formed and filled advantageously by a so called Form, Fill and Seal process (FFS), in which a plurality of cup-like container bodies 11 are formed from a flat sheet of plastic or other suitable material by a vacuum or thermo forming process. Next, the container bodies are filled with substance. After the container bodies 11 of the sheet have been filled, a cover sheet, e.g. an aluminium foil is sealed over the container bodies. The circumferential rims 13 of the containers 10 a formed by cutting waste material away from the sheet between the container bodies. The containers 10 resulting from one sheet may be separated from each other by the cutting operation.

The indented surface 102 which is shown in the figures has a substantially flat surface which lies below the level of the upper surface of the dispensing part 14, preferably at a distance which is less than the thickness of the dispensing part 14. The indented surface 102 provided in the upper surface at the dispensing edge 101 of the dispensing part 14, is preferably shallow in the sense that the indent 102 is just deep enough to prevent that during cutting of the circumferential rims 13 during production, the covering foil is pressed by the cutting tool in the top surface of the dispensing part 14 to such an extent that an inadvertent sealing takes place.

As can be seen in the FIGS. 1*a* and 1*b*, the indent 102 is located in the center of the outlet passage. The indent 102 has a width which is considerably smaller than the width of the outlet passage, such that at least the covering foil in the center of the outlet passage at the dispensing edge 101 is prevented from being inadvertently sealed to the dispensing part 14.

The indent 102 has a decreasing width towards the dispensing edge 101 of the dispensing part 14 as can be seen in FIG. 1*b*. This directs at least the initial flow of substance towards the centre when the rupturable sealing seam 18 starts to rupture due to an increased internal pressure in the container during compression thereof by the dispensing apparatus. This prevents that spreading substance films or jets are created which could contaminate the dispensing machine.

The indent 102 may have a depth that decreases towards the dispensing edge 101.

Figure 2A:
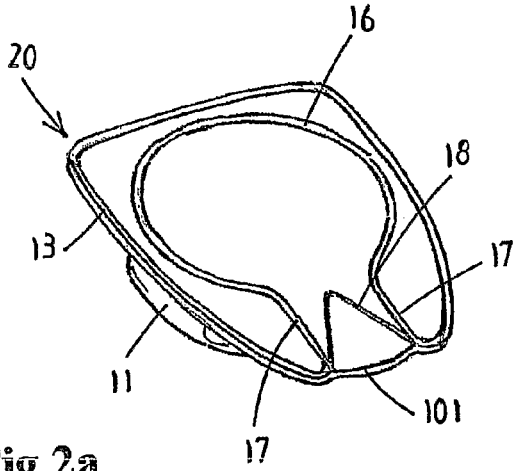
FIG. 2*a* and FIG. 2*b* show in a view in perspective from above and from below respectively, a container according to a second aspect of the invention.
Figure 2B:
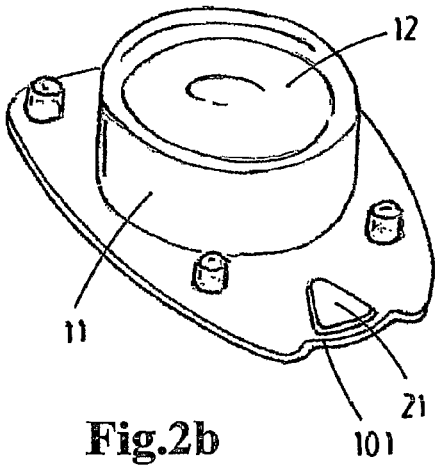

In FIGS. 2*a* and 2*b* another container 20 containing a substance is shown. The container 20 of FIG. 2 has many features in common with the container 10 of FIG. 1. The features of both containers 10 and 12 that are the same are identified with the same reference numerals as in FIG. 1. For a description of those features is referred to the above description referring to FIG. 1.

A relatively shallow indent 21 is provided in the upper surface of the dispensing part 14 of the circumferential rim. The indent 21 extends from a location distant from the dispensing edge 101 of the dispensing part 14 towards the rupturable sealing seam 18. In the example of FIG. 2 the indent 21 has a substantially triangular shape, which widens towards the edge 101 of the dispensing part 14.

The indent 21 does not extend up to the dispensing edge 101 like the indent 102 in FIG. 1, but is located at a distance from the dispensing edge 101 of the dispensing part 14. During production of the containers 20, while cutting the circumferential rims, the foil may be inadvertently sealed to the dispensing edge 101 of the dispensing part 14 by the pressure of the cutting tool. The indent 21 provides the possibility to press on the covering foil at the location of the indent 21 whereby the foil is pressed into the indent 21. This will stress the foil and will rupture any inadvertent seal formed between the dispensing edge 101 of the dispensing part 14 and the foil caused by the cutting tool. This pressing of the covering foil can be done during production, but it is also possible to provide the dispensing apparatus with a member, which will press the foil automatically when the container 20 is placed in the dispensing apparatus.

In a possible embodiment the indent 21 may have a depth that decreases towards the dispensing edge 101.

It is also possible to have the depth of the indent 21 increase towards the dispensing edge 101.

Figure 3:
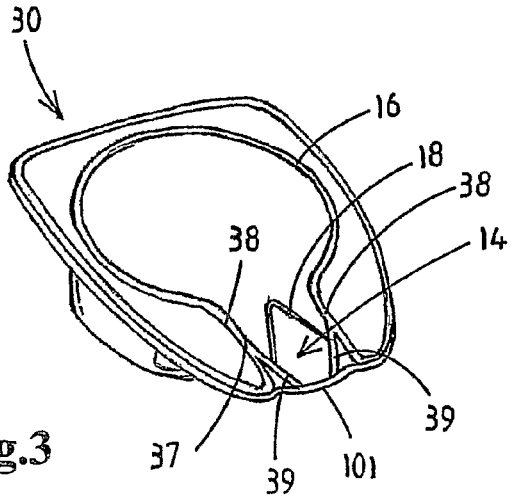
FIG. 3 shows in a view in perspective from above a container according to a third aspect of the invention.

In FIG. 3 a container 30 is shown. The container 30 of FIG. 3 has many features in common with the container 10 of FIG. 1. The features of both containers 10 and 30 that are the same are identified with the same reference numerals as in FIG. 1. For a description of those features is referred to the above description referring to FIG. 1.

The container 30 has a dispensing part 14 that has a substantially flat upper surface.

The sealing seam of the container comprises a circumferential sealing seam 16, a pair of outlet seams 37 and a rupturable sealing seam 18. The circumferential sealing seam 16 seals the foil to the rim over most of the angular range of the circumferential rim.

At the location of the dispensing part 14, the circumferential sealing seam 16 at each end merges in an outlet seam 37. Each of the outlet seams 37 extends towards the dispensing edge 101 of the dispensing part 14, thereby forming between them a dispensing passage 19 between the foil and the upper surface of the dispensing part 14. The outlet seams in the embodiment of FIG. 3 have first portions 38, closest to the filling cavity, which are substantially parallel. The outlet seams 37 furthermore have second portions 39 which converge towards each other in the direction of the dispensing edge 101 of the dispensing part 14.

The passage between the outlet seams 37 is bridged by a rupturable sealing seam 18 sealing of the passage such that the content of the container 10 is closed off from the outside of the container 10.

The rupturable sealing seam 18 as is shown in FIG. 3 has a V-shape with the point of the V directed towards the filling cavity. The legs of the V diverge towards the dispensing edge 101 of the dispensing part 14. It is however conceivable to have another shape of the rupturable sealing seam 18. The rupturable sealing seam 18 has in the shown embodiment a smaller width whereby it is a weakened sealing seam with respect to the other sealing seams of the container. As mentioned also other ways of weakening the rupturable sealing seam 18 are possible.

Figure 7A:
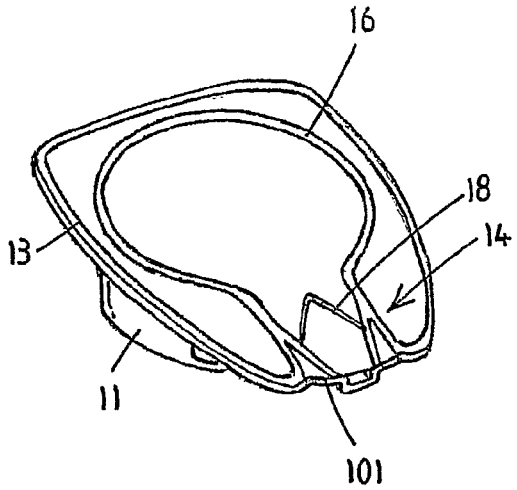
FIG. 7*a* and FIG. 7*b* show in a view in perspective from above and from below respectively, another container according to the first aspect of the invention.
Figure 7B:
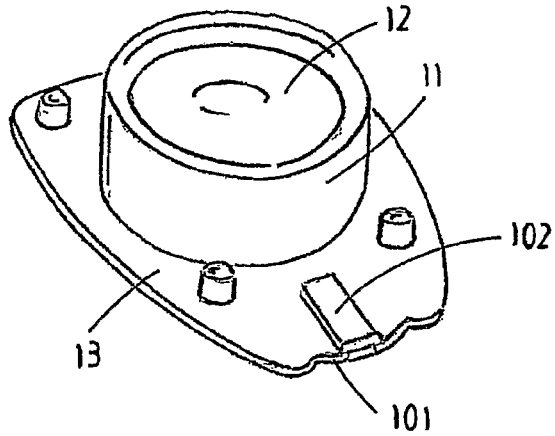

In an alternative embodiment, which is shown in FIG. 7, outlet seams which have substantially parallel first portions 38 and converging second portions 39 similar as in FIG. 3 are provided.

Furthermore the dispensing part 14 in the container 70 of FIG. 7 is provided with an indent like is described with reference to FIG. 1. The difference being that the indent in FIG. 7 has a constant width. The container of FIG. 7 also has many features in common with the container of FIG. 1. The features of both containers that are the same are identified with the same reference numerals as in FIG. 1. For a description of those features is referred to the above description referring to FIG. 1.

Figure 4:
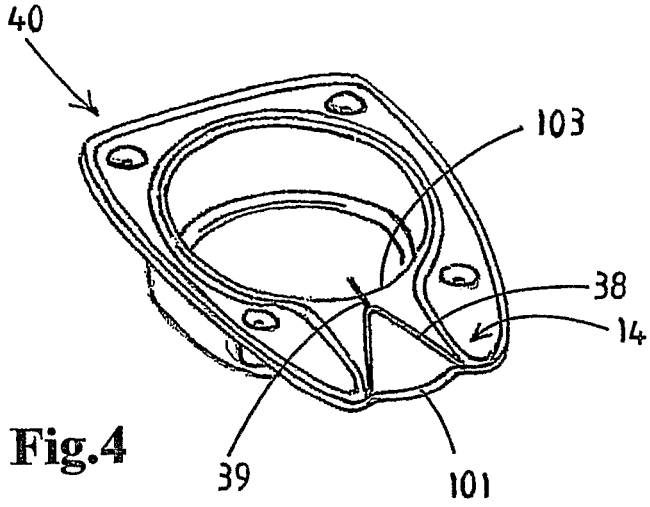
FIG. 4 shows in a view in perspective from above a container according to a fourth aspect of the invention without a covering foil sealed to it.

In FIG. 4 is shown a container 40 containing a substance, which also has many features in common with the container 10 of FIG. 1. Corresponding features are therefore indicated by the same reference numerals. For a description of those features is referred to the above description referring to FIG. 1.

The container 40 has a flat dispensing part 14 of the circumferential rim. The rupturable sealing seam 48 as is shown in FIG. 4 has a V-shape with the point of the V directed towards the filling cavity. The legs of the V diverge towards the dispensing edge 101 of the dispensing part 14. It is however conceivable to have another shape of the rupturable sealing seam 48. The rupturable sealing seam 48 has a tail end seal 49 which extends from the rupturable sealing seam 48 to the edge 103 between the filling cavity and the flat dispensing part 14. The tail end seal 39 is a line shaped seal which extends up to the edge 103. Again the rupturable sealing seam 48 and also, in this embodiment, the tail end seal are thinner than the other sealing seams of the container, whereby they are weakened with respect to the other sealing seams. Thereby can be better assured that the rupturing upon pressurizing the content of the container will take place in the rupturable seal 48.

Figure 5:
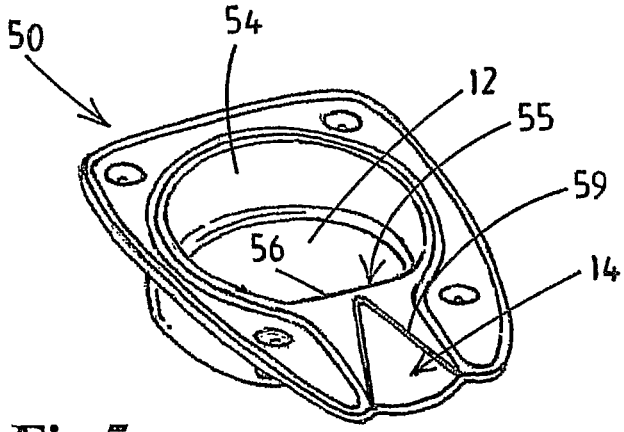
FIG. 5 shows in a view in perspective from above, a container according to a fifth aspect of the invention with a covering foil sealed to it.

In FIG. 5 is shown a container 50 containing a substance, which also has many features in common with the container 10 of FIG. 1. Corresponding features are therefore indicated by the same reference numerals. For a description of those features is referred to the above description referring to FIG. 1.

The container 50 has a dispensing part 14, which has a substantially flat upper surface. The filling cavity has a bottom 12 and a circumferential side wall 54, wherein at least on the side where the dispensing part 14 is located, the side wall 54 has a flat wall portion 55. The edge 56 between the flat wall portion and the flat dispensing part 14 consequently is a straight edge between the filling cavity and the dispensing part.

In practice the outer dimensions of the circumferential rim including the dispensing part are fixed due to the existing dispensing apparatus having a certain dimension for receiving the circumferential rim. The straight edge 56 provides within that constraint in the freedom of design a longer dispensing part 14. This allows the passage to be longer and thus the rupturable sealing seam 59, which is in a V-shape, to be more elongate in shape. Thereby, more cover sheet material is "free" to bulge out around it, and the rupturing will initiate more easily at the point of the V-shape. The V-shaped rupturable sealing seam 59 extending over a longer length portion of the outlet passage provides an easier, more gradual opening of the rupturable seal 59. The substance is under less pressure when the rupturable seal 59 opens gradually. Thereby splashing of the substance upon opening the container is prevented or considerably reduced. Also in this embodiment the rupturable sealing seam 59 may be weakened, e.g. be thinner than the other sealing seams of the container.

Figure 6:
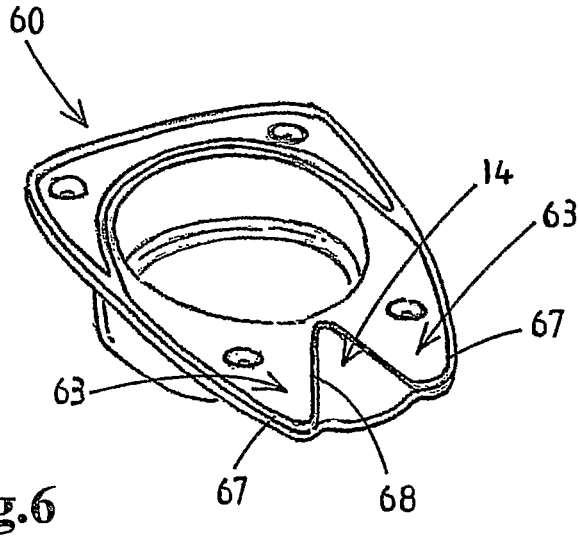
FIG. 6 shows in a view in perspective from above, a container according to a sixth aspect of the invention without a covering foil sealed to it.

In FIG. 6 is shown a container 60 containing a substance, which also has many features in common with the container 10 of FIG. 1. Corresponding features are therefore indicated by the same reference numerals. For a description of those common features is referred to the above description referring to FIG. 1.

In the embodiment of the container shown in FIG. 6 the cover sheet is sealed to the dispensing part 14 by a portion of the circumferential sealing seam that comprises strong seal portions 67 and at least one rupturable sealing seam 68 that interconnects the strong seal portions 67. The rupturable sealing seam has generally a V shape and is preferably thinner than the strong seal portions 67 and thereby weakened. The strong seal portions 67 and said weakened sealing seam 68 together substantially have the shape of a "W", wherein the "W" has diverging outer legs, which are constituted by the strong seals 67. The "W" has inner legs, which are constituted by the weakened sealing seam 68 which inner legs are converging towards the filling cavity.

As can be seen the strong seals 67 are applied at the edge of the circumferential rim or flange. Thereby two lobes 63 are formed on the upper side of the circumferential rim, mainly on the dispensing part 14 thereof, which are in contact with the filling cavity of the container 60. These lobes 63 have a considerable area surface.

The advantage of this sealing seam configuration of FIG. 6 is that there is overall a greater distance between the weakened sealing seam 68 and the strong sealing seams 67 on the dispensing part. Because of the creation of the lobes 63 a greater portion of the covering sheet is allowed to bulge out. Thereby the weak seal 68 will open under a lower internal pressure in the container and a more gradual opening results. A more gradual rupturing under a lower pressure of the weakened sealing seam results in a reduction elimination of the splashing of the outgoing flow of substance.

Figure 8A:
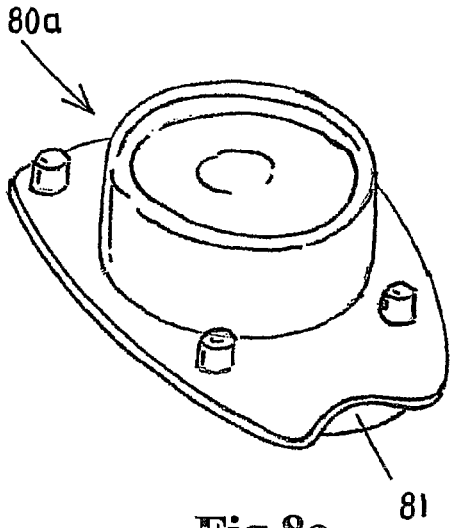
FIGS. 8*a* and 8*b* show a container according to a seventh aspect of the invention.

In FIG. 8*a* is shown another container. The circumferential rim has a dispensing part which is covered by the cover sheet.

The dispensing part at its dispensing edge is recessed with respect of the edge portion of the cover sheet. The recess is indicated by reference numeral 81. The edge of the recess 81 is situated under the cover sheet and is illustrated with a dashed line.

Figure 8B:
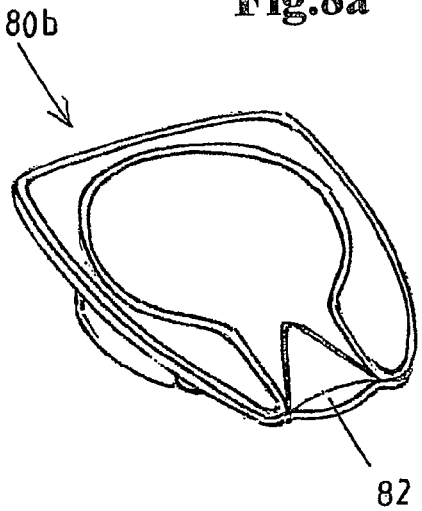

FIG. 8*b* shows an alternative embodiment of the container. In this embodiment the cover sheet is recessed relative to the dispensing edge of the dispensing part. The edge of the recess is indicated by the reference numeral 82.

The containers 80*a* and 80*b* of FIG. 8*a* and FIG. 8*b* have a dispensing edge where the layers of material are not overlying. The recess in either the dispensing part (FIG. 8*a*) or the covering sheet (FIG. 8*b*) results in that during cutting of the circumferential rims during manufacturing of the containers, the covering sheet is not pressed by the cutting tool in the top surface of the dispensing part. Thereby an inadvertent sealing at the dispensing edge is prevented.

It will be appreciated that the features shown in the FIGS. 1 to 8 which are not common for the shown specific embodiments may readily be combined into other embodiments. These embodiments must be considered to be disclosed in this application.

The invention claimed is:

1. A container containing a substance, comprising:

a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which has an edge and which is covered by the cover sheet, which cover sheet is sealed to an upper surface of the dispensing part by at least one rupturable sealing seam and by outlet seams defining an outlet passage from the rupturable sealing seam towards the edge of the dispensing part of the circumferential rim, such that, when the rupturable sealing seam is broken, the substance is allowed to flow through the outlet passage between the upper surface of the dispensing part and the cover sheet towards the edge of the dispensing part, and wherein the dispensing part has an indented surface in the outlet passage, wherein the indented surface is spaced apart from the rupturable sealing seam and the outlet seams and extends over a distance from said edge of the dispensing part towards the rupturable sealing seam.

2. The container according to claim 1, wherein the dispensing part has a certain thickness, the upper surface of the dispensing part has a certain level and the indented surface lies below said level of the upper surface of the dispensing part, at a distance which is less than the thickness of the dispensing part.

3. The container according to claim 1, wherein the indented surface is a substantially flat surface.

4. The container according to claim 1, wherein the outlet passage has a center and the indented surface is located in said center of the outlet passage.

5. The container according to claim 1, wherein the outlet passage has a certain width and the indented surface has a width which is considerably smaller than the width of the outlet passage.

6. The container according to claim 1, wherein the indented surface has a decreasing or increasing width towards the edge of the dispensing part.

7. The container according to claim 1, wherein the indented surface has a constant width.

8. The container according to claim 1, wherein the outlet passage has a certain length and the indented surface has a length which is smaller than the length of the outlet passage.

9. The container according to claim 1, wherein the indented surface has a decreasing or increasing depth towards the edge of the dispensing part.

10. A container containing a substance, comprising:

a preformed deformable body defining a filling cavity, which body has an opening and an integral planar circumferential rim surrounding said opening, which opening is closed by a cover sheet which is sealed to the circumferential rim by means of a circumferential sealing seam, wherein the circumferential rim has a dispensing part which has an edge and which is covered by the cover sheet, which cover sheet is sealed to the dispensing part by at least one rupturable sealing seam and by outlet seams defining an outlet passage from the rupturable sealing seam towards the edge of the dispensing part of the circumferential rim, such that, when the rupturable sealing seam is broken, the substance is allowed to flow through the outlet passage between the upper surface of the dispensing part and the cover sheet towards the edge of the dispensing part, and wherein the dispensing part has an indented surface in the outlet passage, wherein the indented surface is spaced apart from the rupturable sealing seam, the outlet seams and said edge of the dispensing part.

11. The container according to claim 10, wherein the indented surface is of triangular shape.

12. The container according to claim 11, wherein the indented surface widens towards the edge of the dispensing part.

13. The container according to claim 12, wherein the indented surface has a decreasing depth towards the edge of the dispensing part.

14. A system comprising:

a container according to claim 1, and a dispensing apparatus comprising a container receiver, which apparatus is adapted to open the container, wherein the container receiver of the apparatus comprises a compression chamber with a variable volume for receiving the container body and a compression device adapted to compress the container body received in the compression chamber, whereby in use the container is compressed such that the rupturable sealing seam breaks and a flow of substance is ejected from the container.

15. The system according to claim 14, wherein the container receiver of the apparatus comprises a stop face engaging in use a back side of the circumferential rim and a lid in use engaging the cover sheet of the container.

16. A system comprising:

a container according to claim 10, and a dispensing apparatus comprising a container receiver, which apparatus is adapted to open the container, wherein the container receiver of the apparatus comprises a compression chamber with a variable volume for receiving the container body and a compression device adapted to compress the container body received in the compression chamber, whereby in use the container is compressed such that the rupturable sealing seam breaks and a flow of substance is ejected from the container.

* * * * *